United States Patent [19]

Marton

[11] 4,184,291

[45] Jan. 22, 1980

[54] VACUUM HAND SANDING DEVICE

[76] Inventor: Miksa Marton, R.R. #1, Old Castle, Ontario, Canada

[21] Appl. No.: 837,035

[22] Filed: Sep. 27, 1977

[30] Foreign Application Priority Data

May 31, 1977 [CA] Canada ..... 279561

[51] Int. Cl.[2] ..... B24B 23/00

[52] U.S. Cl. ..... 51/170 R; 15/421

[58] Field of Search ..... 51/273, 170 R, 358; 15/421, 410, 322

[56] References Cited

U.S. PATENT DOCUMENTS

| | | | |
|---|---|---|---|
| 2,176,139 | 10/1939 | Lofgren | 15/421 X |
| 2,499,933 | 3/1950 | Smul | 51/362 |
| 3,048,876 | 8/1962 | Kemnitz | 15/421 X |

*Primary Examiner*—Robert L. Spruill
*Assistant Examiner*—Roscoe V. Parker
*Attorney, Agent, or Firm*—Burns, Doane, Swecker & Mathis

[57] ABSTRACT

A vacuum hand sanding device consists of a back-up pad with sanding disc attached thereto detachably secured to a vacuum housing and vacuum source. The back-up pad has a plurality of apertures in the surface thereof and channels therein between the apertures and the housing. In one embodiment, a relief valve is provided on the housing and which can be covered by an operator's hand. In another embodiment, the relief valve is situated on a tubular handle connecting the back-up pad to the vacuum source. Means may be provided for adjustably altering the angle between the pad and the tubular handle.

1 Claim, 8 Drawing Figures

VACUUM HAND SANDING DEVICE

This invention relates to hand operated sanding devices and in particular to such sanding devices which are attached to sources of vacuum.

There is a great need for improvement in hand operated, vacuum sanding devices, particularly those used in such areas as automotive paint shops and drywall finishing. In both areas of operation, airborne dust from sanding operations is an extreme health hazard to the sanding operators.

The present invention provides a hand operated sanding device which, while being usable without suction, is preferably connected to a vacuum source for sucking up dust from the sanded surface as it is created by the operator.

In one embodiment, the back-up pad of the sanding device has air channels therein and is provided with a small suction housing on top of the back-up pad and which will fit within an operator's hand. A vacuum relief valve on the housing is governed by the hand of the operator so that as he covers the opening of the relief valve with his hand, he creates more suction to the work surface, sucking the sanding pad to the surface so that when the operator moves the pad with the suction housing on the work surface, he does not have to apply any downward physical pressure on the pad to make the paper cut the work surface. The suction created by the vacuum itself pulls the sanding pad to the work surface without any pressure from the operator. The operator can easily manipulate the amount of suction with his hand at all times and make the device sand harder or easier and draw up the dust from the work surface which the operator normally would breathe. This embodiment is most useful in areas such as automotive paint shops and gives a very fine sanding result, dust-free. Additionally, the life of the sandpaper is substantially increased as the already cut dust is being sucked up instantly and is not left on the work surface to wear away on the abrasive disc. The abrasive does not cut the dust twice and there is less chance for the dust to clog up the disc. Moreover, the operator can immediately see the results of his sanding operation as there is no dust layer covering the work surface.

In another embodiment, the device is adaptable for use in drywall sanding. Again the apparatus is attached to a source of vacuum and a tubular connection is made between the back-up pad and the vacuum source and the tubular connection is used as a handle as the operator needs to reach ceilings and high wall surfaces in sanding drywall joints. In this embodiment, the relief valve is positioned on the tubular connecting handle and, again, the operator does not have to apply any hard physical pressure on the sanding surface as the vacuum will suck the pad onto the surface itself. The operator, using the handle, can easily move the sanding pad over the surface to be sanded. The vacuum handle is attached to the back-up pad by means of a resilient joint so that the pad can be adjusted to different positions relative to the tubular handle.

It has also been found that abrasive discs referred to as "sand screen" is very useful with this vacuum device when suitably developed for use therewith. In the past, the use of sand screen was limited strictly to wet sanding and was cut to disc shapes. This material is actually made of a screen substance and is coated with an abrasive. The discs were attached to sanding pads by pressure and if the disc got cut somewhere or ran off the sanding surface it dropped off the back-up pad. There was no way to attach this sand screen firmly to a back-up pad and it was limited to wet sanding only. Additionally, when the sand screen is cut the edge of the discs are extremely sharp and wire-like and this created serious and deep scratches on sanded surfaces such as automotive finishes.

In the present invention, I have improved the sand screen for use with a vacuum system and sanding pad so that it can be used for dry sanding and it will collect the dust through the apertures of the screen itself, drawing it in through the pad and into the vacuum source.

According to a broad aspect, the present invention relates to a vacuum sanding device comprising a back-up pad with apertures in the operative surface thereof and adapted to receive an apertured, abrasive sanding disc on said operative side with the apertures in the disc being in registry with the apertures in the pad; means connecting said back-up pad with a vacuum source and a vacuum release valve in said connecting means.

The invention is described by way of example in the accompanying drawings in which.

Figures 1, 2, 3, 4, 5, 6, 7, 8:
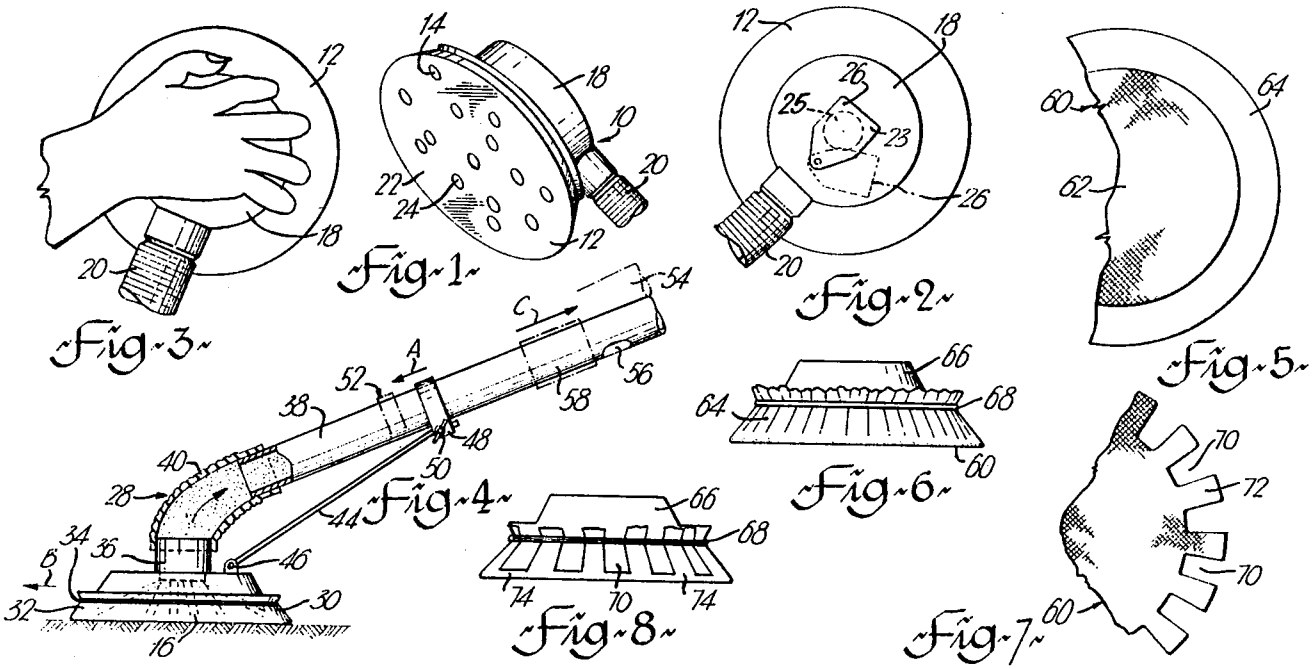
FIG. 1 is a perspective view of the bottom surface of a sanding device according to one embodiment of the present invention.
FIG. 2 is a top view of the device shown in FIG. 1.
FIG. 3 is another top view similar to FIG. 2 but showing the device being used by an operator.
FIG. 4 is an elevation view, partly in section, of another embodiment of the invention.
FIG. 5 is a partially cut away plan view of an abrasive disc usable with the present invention.
FIG. 6 is an elevation view of the abrasive disc of FIG. 5 applied to a back-up pad.
FIG. 7 is another partially cut away plan view of an abrasive screen usable with the present invention.
FIG. 8 is an elevation view showing the abrasive screen of FIG. 7 attached to a back-up pad.

Referring to FIG. 1, the sanding device 10 comprises a circular back-up pad 12 having a plurality of apertures 14 therein which communicate with channels 16 in the interior of the pad (see FIG. 4) the channels in turn terminating in a housing 18 secured to the upper surface of the pad. The housing 18 is detachably secured by means of a flexible hose 20 to a vacuum source not shown. The vacuum source can be a remote vacuum device and the sanding device 10 can be one of a plurality of such devices connected to the source by gang hoses 20 or the hose 20 can be attached at its other end to a portable vacuum source that may be carried on the operator's back.

The back up pad 12 with the interior air channels 16 may be of the type shown in my copending Canadian application No. 240,516 filed Nov. 26, 1975 or in my Canadian application No. 261,983 of Sept. 24, 1976.

The embodiment of FIGS. 1 to 3 is the form in which the device is used in the automotive trade and particularly in automotive paint shops. The back-up pad is provided with a circular abrasive or sanding disc 22 which also has apertures 24 in the surface thereof and which, when the disc is applied to the rotary pad as shown in FIG. 1, are in registry with the apertures 14 in the pad 12. It will be appreciated that when vacuum is applied to the housing 18 and the pad is moved over the work surface, the dust that is created by the sanding operation is drawn through the apertures 14 into the channels 16 and through the hose 20 to the vacuum source.

Referring to FIG. 2, the upper surface of the housing 18 is provided with a vacuum relief valve 23 which consists of an aperture 25 in the upper surface of the housing 18 and a pivotable or slidable door 26 covering the aperture. As shown in FIG. 2, the cover 26 may be swung over to the phantom line position leaving the aperture open to the atmosphere. If the operator shuts the relief valve 23 completely, he has an even vacuum force on the whole sanding surface at all times. When the operator applies the abrasive disc 22 to the sanding pad 12 he may open the relief valve 23 completely and this releases the suction from the sanding surface by allowing the sucked in air to be directed in through the aperture 25 to release the suction from the sanding surface. By using the relief valve, the operator is not shutting off the vacuum suction from the vacuum source but is only changing the suction from the surface of the work to the atmosphere. Accordingly, this does not choke the vacuum suction off completely which could create in some instances a problem with an electric motor in the vacuum apparatus. It will also be appreciated that leaving the relief valve fully open and covering the valve with his hand as shown in FIG. 3, the operator can minutely adjust the amount of vacuum applied to the work surface by easing his hand or a portion of it on and off the relief valve opening. It will also be noted from FIG. 3 that the vacuum housing is small enough to easily fit within the confines of the operator's hand so that it can be moved readily over the surface to be sanded.

Looking at FIG. 4, another embodiment of the invention is disclosed for use in drywall sanding. In the application of plasterboard, the joints between plasterboard sheets and the depressions made by nail holes are filled with a putty-like filler that hardens and must be subsequently sanded. The amount of dust created from sanding drywall filler is extremely high and because workers operate within the confines of closed rooms and move frequently from one room to another in a house or building, the operators therein are not as free from dust laden air as for example an operator would be in a room where vacuum fans, etc. would be used. In the present embodiment of FIG. 4, the sanding device 28 includes a back-up pad 30 having the air channels 16 therein identical to the pad of FIG. 1. The abrasive disc 32 is applied to the lower surface of the back-up pad and is retained thereon by an elastic member 34. The upper surface of the back-up pad is attached to a tubular member 36 and to which the air channels 16 are directed. Tube 36 in turn is connected to a tubular handle 38 by means of a corrugated, semi-rigid, resilient tube 40 not unlike automobile radiator hose. This member 40 provides a certain flexibility between the handle 38 and the back-up pad 30 to allow for angular changes between the two. The working angle may be fixed by means of a tie rod 44 which is pivotally connected at one end 46 to the upper surface of the back-up pad and at the other end is detachably secured to a collar 48 which is slidable along the handle by loosening off a wing nut or the like 50. It will be appreciated that loosening of the collar 48 and sliding it in the direction of arrow A to the ghost position 52 will have the effect of raising the handle 38 to position 54. Conversely, drawing the collar 48 in a direction opposite to arrow A will lower the handle. The provision of the tie rod 44 prevents knuckling or stumbling of the back-up pad 30 when the operator is sanding a ceiling or wall joint in the direction of arrow B.

Tubular handle 38 is connected to a vacuum source, not shown, and as in the previous embodiment, a vacuum relief valve is provided and in this case the valve takes the form of an aperture 56 in the handle of the pipe where the aperture can be partially or fully covered by one hand of the operator or it can be partially or fully covered by means of a slidable collar 58 moved in the direction of arrow C. Again, the operator does not have to apply any substantial physical pressure on the sanding surface because the vacuum will draw the back-up pad and sanding disc downwardly onto the surface to be sanded. Referring to FIG. 5, an abrasive disc is shown of the type commonly referred to as "sand screen" material which has the appearance of fine window screen coated with a cutting abrasive. The abrasive disc 60 of the present invention comprises a central portion 62 which includes the rather stiff, abrasive coated screen and a concentric, peripheral skirt portion 64 beyond the central portion for use in attaching the disc to a back-up pad 66 as shown in FIG. 6. In the embodiment of FIG. 5, the sand screen disc 60 is substantially larger than the back-up pad 66 and the skirt portion 64 is provided by softening a peripheral strip of the abrasive surface by means of rollers, punches or the like which break substantially all of the grits off of the screen leaving only the nylon screen itself which is soft and flexible, similar to linen and this soft portion can be folded up along the inwardly sloping side edges of the back-up pad 66 and held in position by an elastic band 68 as shown in FIG. 6.

Another embodiment of the sand screen is shown in FIG. 7 where the disc has been provided with a plurality of radially cut grooves 70 directed inwardly from the outer peripheral edge of the disc toward the center thereof. The length of the grooves and the tabs 72 therebetween is such that when the tabs are folded up around the inwardly sloping surface of the back-up pad 66, approximately a quarter of an inch of full abrasive surface 74 is left beyond the terminal edge of the pad and this will fold up on the side of the pad by the pressure of the rubber ring 68 that snaps into the pad groove and holds the sand screen disc 60 to the back-up pad so that the bottom of the cut out groove 70 cannot touch the surface of the work and leave scratch marks.

It will be appreciated that by using sand screen discs with the vacuum system it can be used for dry sanding and collects the dust through the fine apertures of the screen itself, the dust being sucked in through the pad into the housing and then to the vacuum source. The apertures in the screen are large enough to prevent the screen from clogging and by sucking through the sand screen, the fast air flow created by the vacuum keeps the sanded surface cooled at all times. This is very useful in some automobile plants where the operators sand a fairly hot primer paint. Additionally, the same back-up pad can be used to wet sand. The sand screen can be firmly attached to the back-up pad and instead of using suction in the suction chamber, a light application of water through the suction hole is used, feeding the water through the back-up pad holes and through the sand screen to the sanded surface. This washes the sand screen through the holes and also prevents all heavy edge marks on the sanded surface as the sanding disc is made into an endless, edgeless sanding disc.

It will also be appreciated that while one form of vacuum release valve is shown in the present application, an automatic form of valve can be used as disclosed in my above-mentioned Canadian application No. 240,516 filed Nov. 26, 1975.

While the present invention has been described in connection with specific embodiments thereof and in specific uses, various modifications thereof will occur to those skilled in the art without departing from the spirit and scope of the invention as set forth in the attached claims.

The terms and expressions which have been employed in this disclosure are used as terms of description and not of limitation and there is no intention in the use of such terms and expressions to exclude any equivalents of the features shown and described or portions thereof, but it is recognized that various modifications are possible within the scope of the invention as claimed.

I claim:

1. A vacuum hand sanding device comprising a back-up pad with apertures in the operative surface thereof and adapted to receive an apertured, abrasive sanding disc on said operative surface with the apertures in the disc being in registry with the apertures in the pad; and means for connecting said back-up pad with a vacuum source comprising a housing mounted on the top of the back-up pad with a tubular member on the side of the housing for connection to a vacuum source and with a relief valve positioned on the upper surface of the housing and operable by the hand of an operator during use of the sander and comprising an aperture in said upper surface of the housing for progressive and selective closing by the hand of an operator and including a pivotally mounted door over said aperture for selecting the amount of relief from said vacuum; said housing being smaller in area than said back-up pad and of a size so as to be operable by one hand.

* * * * *